US006649884B2

(12) United States Patent
Nonomura

(10) Patent No.: US 6,649,884 B2
(45) Date of Patent: Nov. 18, 2003

(54) SANITARY DEVICE

(75) Inventor: Mitsugu Nonomura, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/101,744

(22) Filed: Mar. 21, 2002

(65) Prior Publication Data

US 2002/0134777 A1 Sep. 26, 2002

(30) Foreign Application Priority Data

Mar. 21, 2001 (JP) ..... 2001-081330

(51) Int. Cl.[7] ..... H05B 1/02; E03D 9/08
(52) U.S. Cl. ..... 219/494; 219/501; 4/420.2
(58) Field of Search ..... 219/494, 501; 392/449–454; 4/420.2, 447, 443

(56) References Cited

U.S. PATENT DOCUMENTS 4,237,560 A * 12/1980 Riegelman et al. ..... 4/447
6,430,366 B1 * 8/2002 Mizutani et al. ..... 392/449

FOREIGN PATENT DOCUMENTS

| | | |
|---|---|---|
| JP | 5-44241 | * 2/1993 |
| JP | 11-267967 | * 10/1999 |
| JP | 11-269967 | * 10/1999 |
| JP | 2000-186360 | * 7/2000 |

* cited by examiner

*Primary Examiner*—John A. Jeffery
(74) *Attorney, Agent, or Firm*—Oblon, Spivak, McClelland, Maier & Neustadt, P.C.

(57) ABSTRACT

A sanitary device includes a microcomputer for controlling a temperature of a cleansing water in a heating water tank to a target value, a control substrate installing the microcomputer and a non-volatile memory memorizing a correction value for the target value. The microcomputer corrects the correction value based on the variation of a circuit constant of the control substrate. The microcomputer of the sanitary device further controls a temperature of a toilet seat or a temperature of a drying air to each target value.

4 Claims, 8 Drawing Sheets

SANITARY DEVICE

The present application is based on and claims priority under 35 U.S.C §119 with respect to Japanese Patent Application No. 2001-081330 filed on Mar. 21, 2000 (13th Year of Heisei), the entire content of which is incorporated herein by reference.

BACKGROUND OF THE INVENTION

1. Field of the Invention

This invention relates to a sanitary device which controls temperatures of cleansing water, drying air or a toilet seat.

2. Description of the Related Art

Generally, a sanitary device 1 as shown in FIGS. 5–8 controls the temperature of cleansing water for cleansing human private parts such as anus or pubic parts, and drying air for drying such parts after cleansing, or the toilet seat. The sanitary device 1 according to FIG. 5 includes an operation panel 4, a cleansing nozzle 7, a heater 14 for heating the water, a drying air control unit 16 and control substrate 19. The operation panel 4 includes a heating water switch 21 for the heater control, a toilet seat switch 22, a drying air switch 23, a bidet cleansing switch 24, a cleansing switch 25 for cleansing an anus, a stop switch 26 and LED displays 51 for indicating controlled conditions of each switch as shown in FIG. 6.

In the control substrate 19, a microcomputer 31 is connected to various thermistors and control circuits such as heating water thermistor 52, toilet seat thermistor 53, room temperature thermistor 54, heating water control circuit 33, toilet seat heater control circuit 34, drying air unit drive circuit 35, water passage control circuit 36 and LED control circuit 37. Further, the microcomputer 31 in the control substrate 19 is connected to the heating water switch 21, the toilet seat switch 22, the drying air switch 23, the bidet cleansing switch 24, the cleansing switch 25 for cleansing anus and the stop switch 26.

Further, in the control substrate 19, the heating water control circuit 33 is connected to the heating water heater 14, the toilet seat heater control 34 is connected to a toilet seat heater 15, the drying air unit drive control circuit 35 is connected to the drying air unit 16, the water passage control circuit 36 is connected to the cleansing nozzle 7, and the LED control circuit 37 is connected to each LED 51 display in the operation panel 4.

According to the sanitary device shown at 1 in FIG. 5, after the toilet cover 2 is opened, when a user seated on the toilet seat 3 pushes the bidet cleansing switch 24, or the cleansing switch 25 for cleansing an anus, the microcomputer 31 in the control substrate 19 opens the main valve 5 and a switching valve 6 through the water passage control circuit 36 to supply cleansing water to the cleansing nozzle 7. In response to the pushing operation of the switch 24 or 25, the corresponding inner cylinder 8 is advanced to a selected position to eject the water from a nozzle hole 9 provided at the top end of the inner cylinder 8 onto the human part to be cleaned.

When the heating water switch 21 of the operation panel 4 according to the sanitary device 1 of FIG. 5 is pushed down, the microcomputer 31 in the control substrate 19 controls the output of the heating water heater 14 by the heating water heater control circuit 33 to adjust the temperature of the cleansing water in the heating water tank 17. The temperature of the cleansing water in the heating water tank 17 can be controlled to be either "intermediate" which is set to be the target value of 40° C., "high" which is set to be the target value plus 3° (43° C.), or "low" which is set to be the target value minus 3° (37° C.).

The selected value is indicated by the corresponding LED 51 display by the microcomputer 31 in the control substrate 19 through the LED control circuit 37. (In FIG. 6, the three LEDs are provided below the heating water switch 21). The temperature of the cleansing water in the heating water tank 17 is measured by the thermistor 52 provided in the tank 17.

When the drying air switch 23 of the operation panel 4 is pushed down, the microcomputer 31 of the control substrate 19 controls the output of the drying air unit 16 by the drying air unit drive control circuit 35 to adjust the temperature of the drying air from the outlet 18. The temperature of the drying air from the outlet 18 can be controlled to be either "intermediate" which is set to be the target value of 40° C., "high" which is set to be the target value plus 3° (43° C.), or "low" which is set to be the target value minus 3° (37° C.).

The selected value is indicated by the corresponding LED 51 display by the microcomputer 31 in the control substrate 19 through the LED control circuit 37. (In FIG. 6, the three LEDs are provided below the drying air switch 21).

The temperature of the drying air from the outlet 18 is measured by the room temperature thermistor 54.

When the toilet seat switch 22 on the operation panel 4 is pushed down, the microcomputer 31 of the control substrate 19 controls the output of the toilet seat heater 15 by the toilet seat heater control circuit 45 to adjust the temperature of the toilet seat 3. The temperature of the seat 3 can be controlled to be either "intermediate" which is set to be the target value of 40° C., "high" which is set to be the target value plus 3° (43° C.), or "low" which is set to be the target-value minus 3° (37° C.).

The selected value is indicated by the corresponding LED 51 display by the microcomputer 31 in the control substrate 19 through the LED control circuit 37. (In FIG. 6, the three LEDs are provided below toilet seat switch 22).

The temperature of the toilet seat 3 is measured by the toilet seat thermistor 53.

The control of the above temperatures is not accurate due to the lack of accuracy or reliability of the fixed resistor 56 (FIG. 8) used in the control substrate 19, which influences the circuit constant of the control substrate 19 for each product. In order to prevent control deviation generated due to such variance of the circuit constant, the following adjustment operation is performed during the assembling process of the control substrate.

For example, adjustment work for the cleansing water control in the heating water tank 17 will be explained. As shown in FIG. 8, a pseudo resistor 57 corresponding to a target value 59 (corresponding to the intermediate target value "intermediate" temperature 40° C.) is connected to a connecting connector 62 (to be connected to the heating water thermistor 52) of the control substrate 19. The microcomputer 31 reads the output from the pseudo resistor 57 as an A/D value 58 by converting to the temperature.

When the A/D value 58 is higher than the target value 59, the microcomputer 31 turns on the "high" display LED 51 (one of the three LEDs provided below the heating water switch 21) of the operation panel 4. When the A/D value 58 is equal to the target value 59, the microcomputer 31 turns on the "intermediate" display LED 51 (one of the three LEDs provided below the heating water switch 21) of the operation panel 4 and when the A/D value 58 is lower than the target value 59, the microcomputer 31 turns on the "low"

display LED 51 (one of the three LEDs provided below the heating water switch 21) of the operation panel 4.

A worker of the assembling process manually adjusts the gain for the variable resistor 101 installed on the control substrate 19 to turn on the "intermediate" display LED 51 (one of the three LEDs provided below the heating water switch 21). This can absorb the variance of the circuit constant of the control substrate 19 to prevent the control difference or the control deviation during temperature controlling of the cleansing water in the heating water tank 17.

Further, in the sanitary device 1 in FIG. 5, under the normal use condition that the heating water thermistor 52 is connected to the connecting connector 62 of the control substrate 19, the three step temperature control ("high", "intermediate" and "low") of the cleansing water in the heating water tank 17 can be made keeping the temperature difference (here, 3° C.) to shift from the high side or from the low side by adjusting the gain of the variable resistor 101 installed on the control substrate 19. According to this structure, the temperature can be preset in accordance with the individual preference or the weather characteristics or the conditions in the area where the device is to be sold.

However, in order to prevent the variance in temperature control for the cleansing water in the heating water tank 17, the worker of the assembly line of the control substrate manually adjusts the gain of the variable resistor 101 on the control substrate by confirming whether the "intermediate" LED display 51 (one of the three LEDs provided below the heating water switch 21) is turned on or not. This manual adjusting operation is one of the most troublesome operations in the entire manufacturing process.

The above manual adjusting operation is applied to the other controls such as the toilet seat temperature control or the drying air temperature control from the outlet 18.

It is troublesome to adjust the gain of variable resistor 101 on the control substrate to preset the temperature of the cleansing water in the heating water tank 17 in accordance with the individual preference or the weather conditions in the area where the device is to be sold, because the cover of the housing 20 (FIG. 5) has to be opened when such adjustment is carried out.

The above manual adjusting operation is also applied to the other controls such as the toilet seat temperature control or the drying air temperature control from the outlet 18.

SUMMARY OF THE INVENTION

It is therefore an object of the present invention to provide a sanitary device with an effective manufacturing process.

It is another object of the present invention to provide a sanitary device which facilitates the adjusting process to absorb the variance of the circuit constant of the control substrate for preventing the control difference or the deviation generated upon temperature control.

It is a further object of the invention to provide a sanitary device which can facilitate the adjusting work for presetting the temperature in accordance with the individual preference or the weather conditions of a specified area.

According to a first aspect of the invention, the sanitary device includes a microcomputer for controlling a temperature of cleansing water in a heating water tank to a target value, a control substrate installed on the microcomputer and a non-volatile memory memorizing a correction value for the target value, wherein the microcomputer corrects the correction value based on the variance of a circuit constant of the control substrate.

According to a second aspect of the invention, the sanitary device includes a microcomputer for controlling a temperature of a drying air supplied from a drying air unit to a target value, a control substrate installed on the microcomputer and a non-volatile memory memorizing a correction value for the target value, wherein the microcomputer corrects the correction value based on the variance of a circuit constant of the control substrate.

According to a third aspect of the invention, the sanitary device includes a microcomputer for controlling a temperature of toilet seat to a target value, a control substrate installed on the microcomputer and a non-volatile memory memorizing a correction value for the target value, wherein the microcomputer corrects the correction value based on the variance of a circuit constant of the control substrate.

The other temperature controls, such as drying air temperature control or toilet seat temperature control are also achieved by this invention.

According to another aspect of the present invention, the sanitary device includes a microcomputer for controlling a temperature of a cleansing water in the heating water tank to a target value, a control substrate installed on the microcomputer, an operation switch connected to the control substrate and a non-volatile memory memorizing a correction value for the target value, wherein the microcomputer corrects the correction value based on the operation of the operation switch.

According to a further aspect of the present invention, the sanitary device includes a microcomputer for controlling a temperature of a drying air supplied from a drying air unit to a target value, a control substrate installed on the microcomputer, an operation switch connected to the control substrate and a non-volatile memory memorizing a correction value for the target value, wherein the microcomputer corrects the correction value based on the operation of the operation switch.

According to still another aspect of the present invention, the sanitary device includes a microcomputer for controlling a temperature of a toilet seat to a target value, a control substrate installed on the microcomputer, an operation switch connected to the control substrate and a non-volatile memory memorizing a correction value for the target value, wherein the microcomputer corrects the correction value based on the operation of the operation switch.

According to the invention, in the sanitary device, the microcomputer installed on the control substrate controls the temperature of the cleansing water in the heating water tank to the target value to adjust the temperature based on the individual preference or weather conditions by a correction value memorized in the non-volatile memory.

The microcomputer corrects the correction value memorized in the non-volatile memory based on the operation of the operation switch to adjust the temperature based on the individual preference or the weather condition to facilitate the adjusting work.

The other temperature controls, such as drying air temperature control or toilet seat temperature control are also achieved by this invention.

According to a further aspect of the present invention, the sanitary device further includes a predetermined range for correcting the correction value.

According to a still further aspect of the present invention, the sanitary device further includes an indicating means for indicating the target value reflecting the correction value.

DETAIL DESCRIPTION OF THE PREFERRED EMBODIMENTS

The embodiments of the invention will be explained with the reference to the attached drawings.

Figure 1:
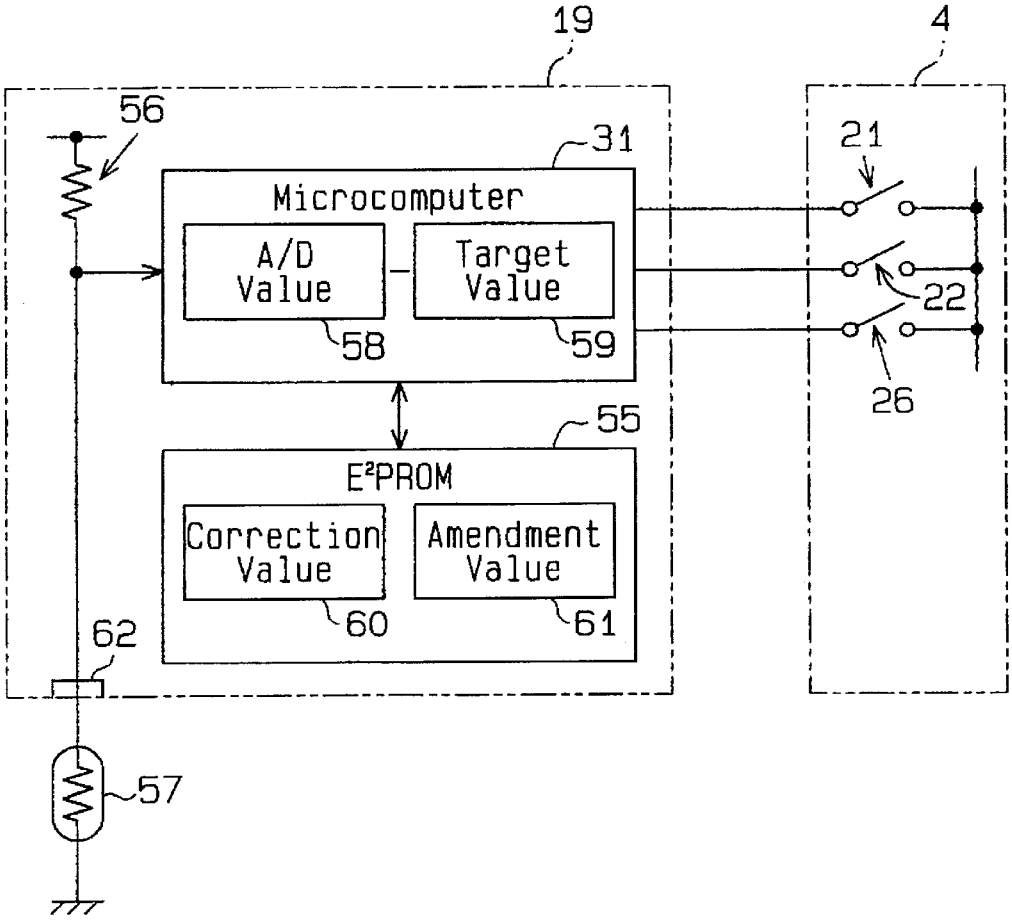
FIG. 1 is a part of a block diagram of a sanitary device according to the invention.
Figure 5:
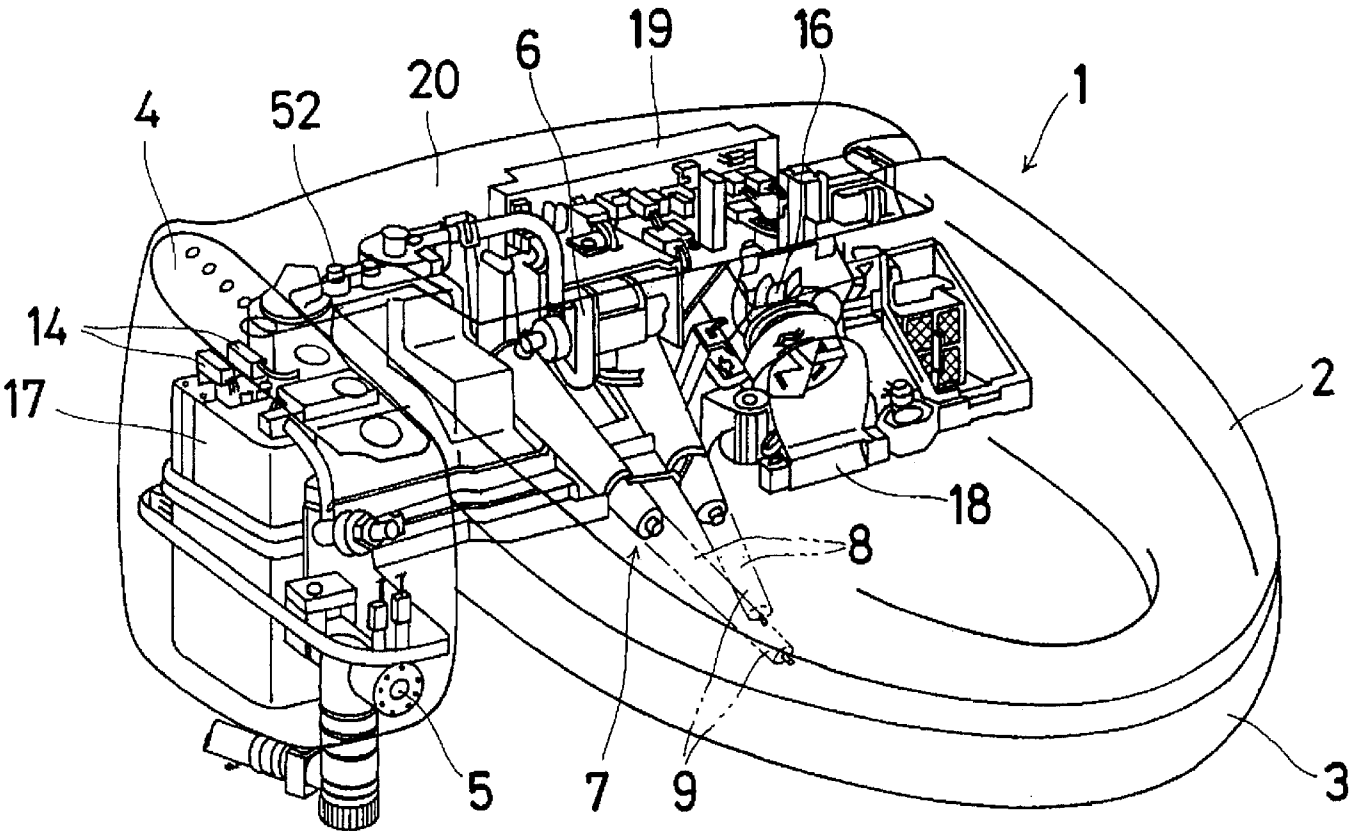
FIG. 5 is a perspective view of the sanitary device according to the present invention and a conventional art.
Figure 6:
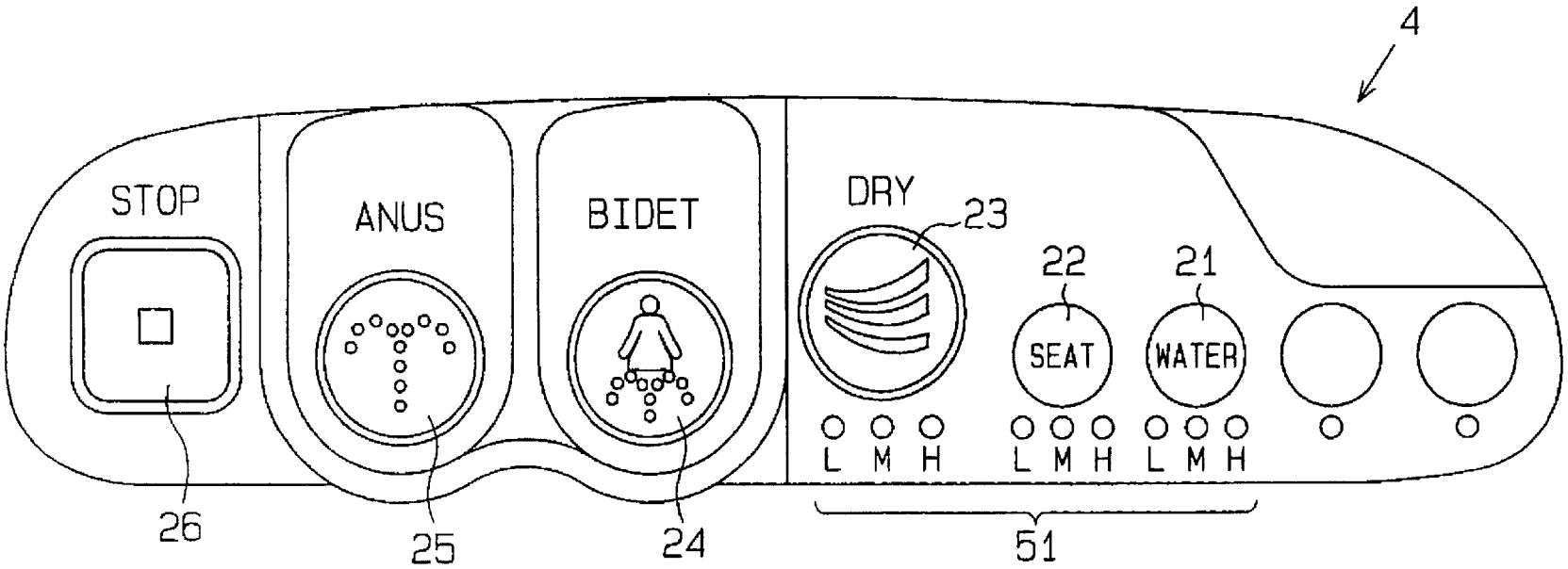
FIG. 6 is a front view of the operation panel according to the present invention and a conventional art.
Figure 7:
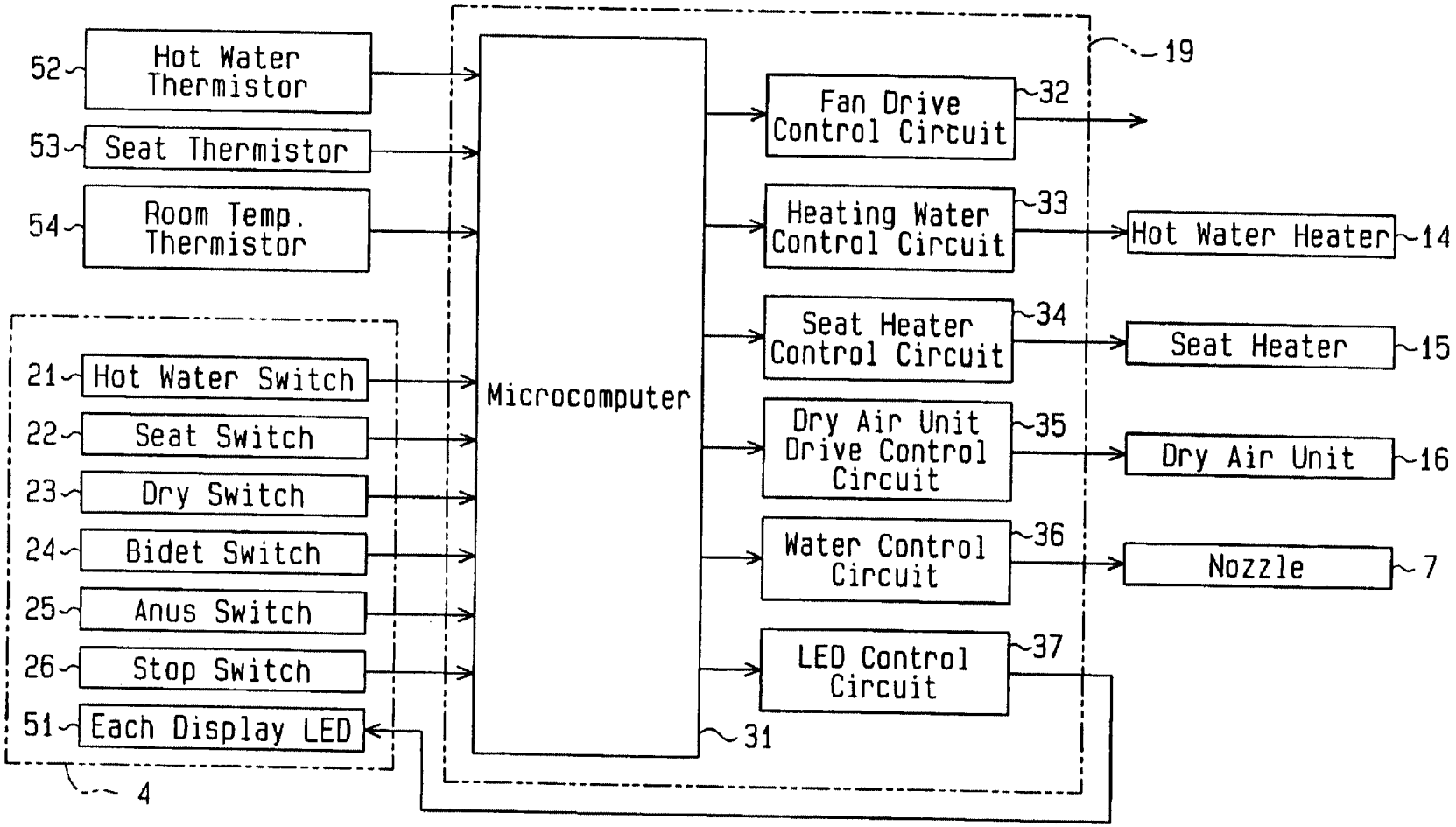
Fig.7 PRIOR ART
FIG. 7 is a block diagram of the sanitary device according to the conventional art.

The sanitary device of the present invention shown in FIG. 1 includes an $E^2$ PROM 55 (corresponding to the non-volatile memory) on the control substrate 19 in addition to the conventional sanitary device in FIG. 5 and omits the variable resistor 101 of the control substrate 19. The sanitary device 1 according to the present invention prevents the control difference in the circuit constant of the control substrate 19, requiring an adjustment operation upon the assembly process of the control substrate, according to the flow chart shown in FIG. 2.

Figure 2:
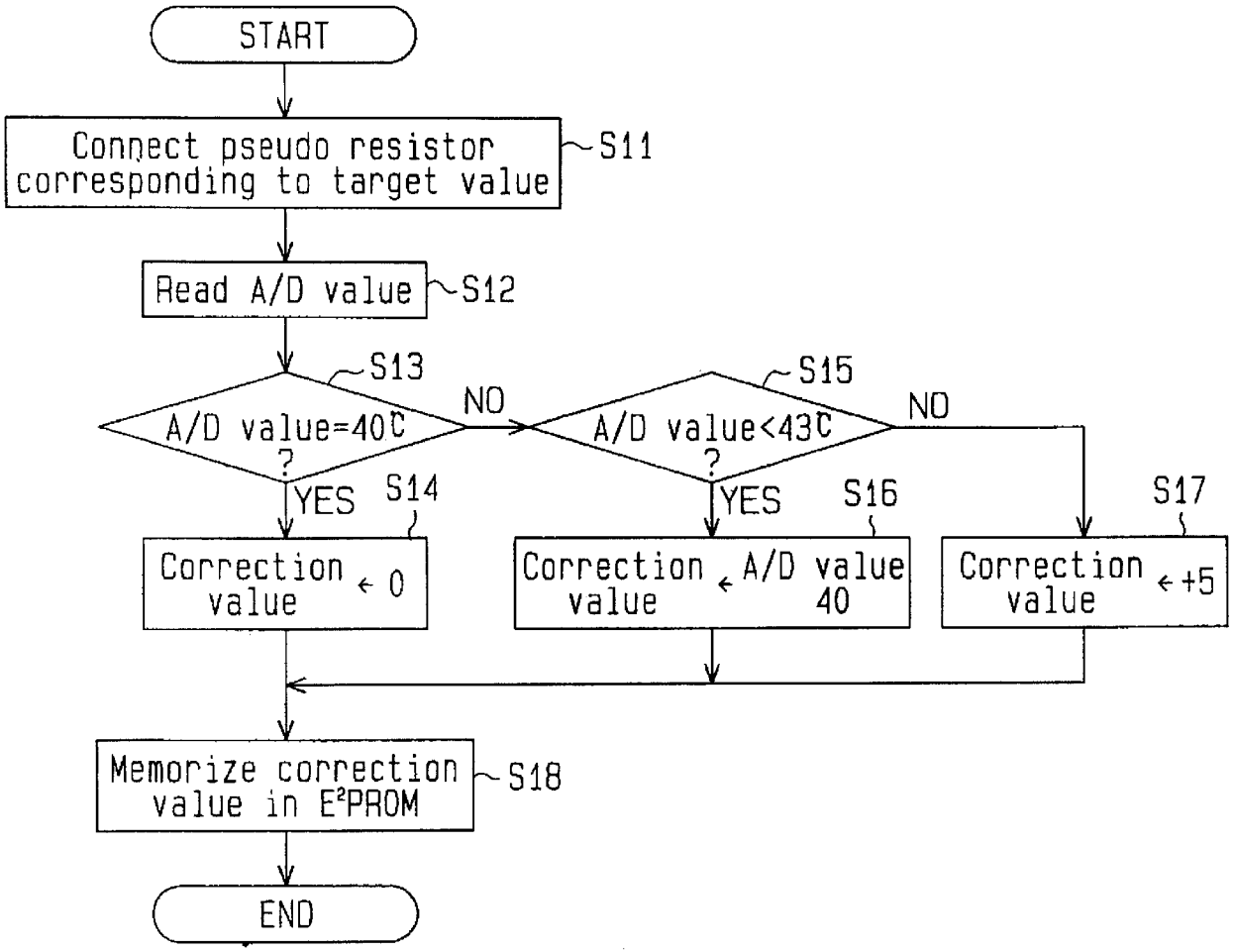
FIG. 2 is a flow chart showing a procedure of the sanitary device to be implemented according to the invention and explaining the adjusting operation to absorb a variance of the circuit constant of the control substrate which causes the control difference of the temperature control.

Explaining now the temperature control of the cleansing water in the heating water tank 17 with reference to FIG. 2, first, at step S11 the pseudo resistor 57 corresponding to the target value 59 ("intermediate" temperature on the display LED 51 on the operation panel 4: 40° C.) is connected to the connecting connector of the control substrate 19 (to be connected to the heating water thermistor 52) and then the microcomputer reads the output value from the pseudo resistor 57 as the A/D value by conversion.

At step S13, the microcomputer 31 judges whether the outputted A/D value 58 is equal to the target value 59 (40° C.) or not. If the microcomputer 31 judges that the A/D value 58 is equal to the target value 59 (S13: Yes), "0" is inputted to substitute for the correction value 60 at step S14 and the control proceeds to the step S18 to memorize the correction value 60 in $E^2$PROM 55. If the microcomputer 31 judges that the A/D value is not equal to the target value (S13: No), then it proceeds to step S15 to judge whether the A/D value is smaller than the value "43° C." or not.

When the value AID 58 is judged to be smaller than the value "43° C." (S15: Yes), control proceeds to step S16 to substitute the correction value for "the detected A/D value 58 minus 40" and proceeds to step S18 to memorize the value in the $E^2$PROM 55. In more detail, when the detected A/D value 58 is 39° C., the memorized value in the $E^2$PROM 55 as the correction value 60 is "−1" and when the detected A/D value 58 is 42° C., the memorized value in the E2PROM 55 as the correction value 60 is "+2".

If the microcomputer 31 judges that the A/D value 58 is not smaller than the value "43° C." (S15: No), proceeds to step S17 to substitute the correction value 60 for the value "+5" and proceeds to step S18 to memorize the value as the correction value 60 in the $E^2$PROM 55. In this case, however, if the control substrate 19 is judged to be not reliable and the board is exchanged for another one from a safety point of view, the procedure is repeated for the new board 19 from the step S11.

The correction value 60 memorized in the $E^2$PROM 55 according to the sanitary device 1 is reflected on the temperature control of the cleansing water in the heating water tank 17 in actual use to absorb the variations of the circuit constant of the control substrate 19 to prevent the control difference or deviation affecting the temperature control of the cleansing water in the tank 17.

Similarly, the control differences in toilet seat temperature and the drying air temperature from the outlet 18 are also prevented.

Figure 3:
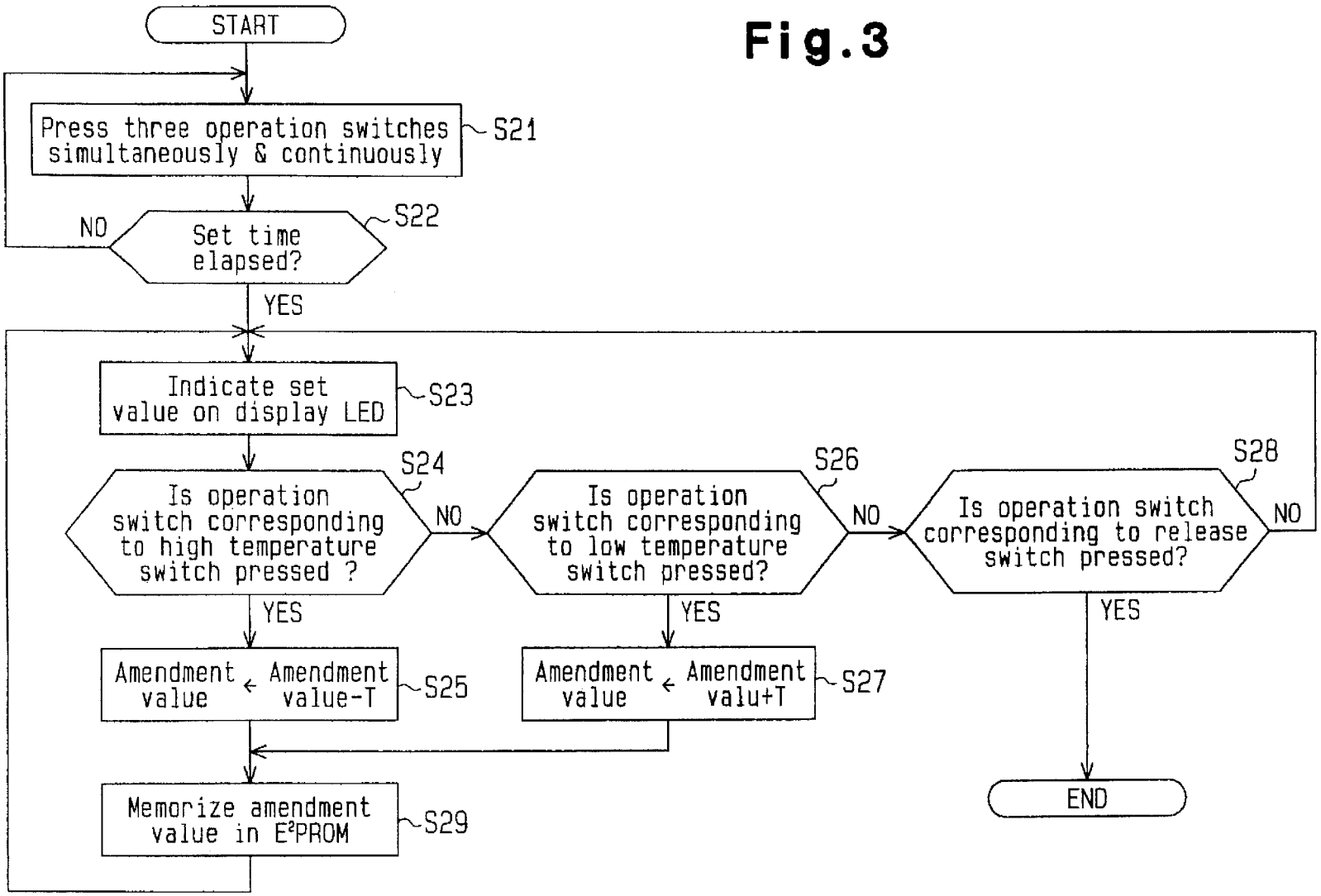
FIG. 3 is a flow chart showing a procedure of the sanitary device to be implemented according to the invention and explaining the adjusting operation to adjust the temperature based on the individual preference or the weather characteristics of the area where the device is to be used.

As shown in the flow chart in FIG. 3, the amended value in the amendment value 61 memorized in the $E^2$PROM 55 can be changed by the operation panel 4.

In FIG. 3, when the three operation switches (heating water switch, toilet seat switch 22 and stop switch 26) on the operation panel 4 are operated at the same time continuously at step S21, the microcomputer 31 judges whether the time that the three switches are pushed at the same time continuously exceeds a predetermined time (for example 6 seconds) or not.

When the microcomputer 31 judges the time that the three switches are pushed at the same time continuously does not exceed the predetermined time (S22: No), the procedure returns to the step S21. On the other hand, when the microcomputer 31 judges the time that the three switches are pushed at the same time continuously exceeds the predetermined time (S22: Yes), it proceeds to step S23 to calculate predetermined values to indicate and display the values on the display LED 51 by the combination of the nine (9) ON indications and proceeds to step S24.

At the step S24, the microcomputer 31 judges whether an operation switch (for example heating water switch 21) corresponding to the "High" temperature switch is operated or not. If the microcomputer 31 judges "Yes" (S24: Yes), at step S25 the amendment value 61 is substituted for the value subtracted by the constant value T and control proceeds to step S29 to memorize the corrected value 61 in the $E^2$PROM 55. For example, assuming that the initial amendment value 61 is "0" and that the constant value T is "+1",the new corrected value 61 is "+1" which is memorized in the $E^2$PROM 55. On the other hand, if the microcomputer 31 judges "No" (524: No), then proceeds to step S26 to judge whether an operation switch (for example, toilet seat switch 22)) corresponding to the "Low" temperature switch is operated or not. If the microcomputer 31 judges "Yes" (S26: Yes), at step S27 the amendment value 61 is substituted for the value added by the constant value T and control proceeds to step S29 to memorize the corrected value 61 in the $E^2$PROM 55. For example, assuming that the initial amendment value 61 is "0" and that the constant value T is "+1", the new corrected value 61 is "+1" which is memorized in the $E^2$PROM 55.

On the other hand, if the microcomputer 31 judges "No" (S26: No), it then proceeds to step S28 to judge whether a release operation switch (for example, stop switch 26)

corresponding to the "release" switch is operated or not. If the microcomputer 31 judges "Yes" (S28: Yes), the procedure of the flow chart in FIG. 3 terminates.

When the microcomputer 31 judges that the "release" switch is not operated (S28: No) or after the execution of the procedure at step S29, the microcomputer 31 returns to step S23 to indicate the values defined by the combination of the nine display LEDs 51 and repeats the procedure.

The predetermined value is defined by the value of the target value 59 ("intermediate" temperature of the display LED 51: 40° C.) subtracted by corrected value of the amendment value 61 and means "Intermediate" temperature among the three step adjustable temperatures of the cleansing water in the heating water tank 17, "High", "Intermediate" and "Low" upon adjusting. The target value 59 (corresponding to the "Intermediate" temperature of the display LED 51) subtracted by the value of the amendment value 61 has been already reflected by the changed correction value 60 at the step S18.

Accordingly, according to the sanitary device 1 of the embodiment, the value of amendment value 61 memorized in the $E^2$PROM 55 can be changed by the switch operation of the operation panel 4 while keeping the temperature difference (here, 3° C.) among the three adjustable temperatures "High", "Intermediate" and "Low" for the cleansing water in the tank 17, the temperature can be shifted to higher side or lower side based on the individual preference or the weather conditions in the area to be used.

Figure 4:
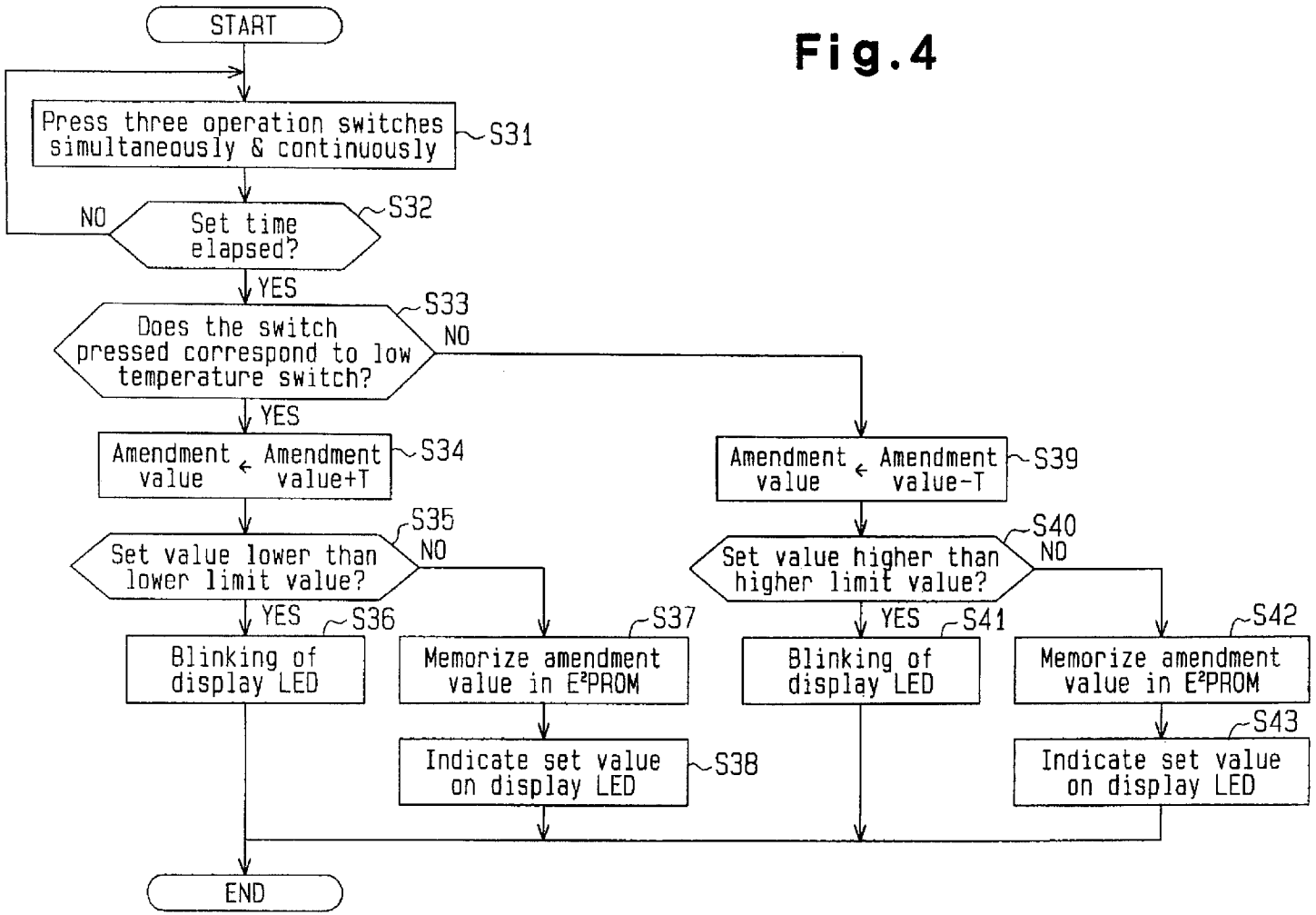
FIG. 4 is a flow chart showing a procedure of the sanitary device to be implemented according to the invention explaining the adjusting operation to adjust the temperature based on the individual preference or the weather characteristics of the area where the device is to be used, but showing another method.

The amended value of the amendment value 61 memorized in the $E^2$PROM 55 can be changed according to the flow chart shown in FIG. 4 on the operation panel 4.

In FIG. 4, when the three operation switches (heating water switch, toilet seat switch 22 and stop switch 26) on the operation panel 4 are operated at the same time continuously at step S31, the microcomputer 31 judges whether the time that the three switches are pushed at the same time continuously exceeds a predetermined time (for example 6 seconds) or not at step S32.

When the microcomputer 31 judges the time that the three switches are pushed at the same time continuously does not exceed the predetermined time (S32: No), the procedure returns to the step S31. On the other hand, when the microcomputer 31 judges the time that the three switches are pushed at the same time continuously exceeds the predetermined time (S32: Yes), it proceeds to step S33.

At the step S33, the microcomputer 31 judges whether an operation switch (for example toilet seat switch 22) corresponding to the "Low" temperature switch is operated or not. If the microcomputer 31 judges "Yes" (S33: Yes), at step S34 the amendment value 61 is substituted for the value added by the constant value T and control proceeds to step S35. At the step S35, the microcomputer 31 judges whether the set value determined by subtracting the amended value of the amendment value 61 from the target value 59 (corresponding to the "Intermediate" temperature of the display LED 51) is lower than a lower temperature limit value (for example 30° C.).

If the microcomputer 31 judges "Yes" (the set value is smaller than the limit value "30° C." and flow chart indicates "Yes" at S35), then proceeds to step S36 to turn on/off one of the nine display LEDs 51 and terminates procedures in the flow chart shown in FIG. 4.

Accordingly, according to the sanitary device 1 of the embodiment, the temperatures of the cleansing water in the heating water tank 17 can be prevented from shifting to each lower side from "High" (from 27° C.), "Intermediate" (from 30° C.), and "Low" (from 33° C.), and at the same time the operation of the "Low" temperature switch at the step S33 can be determined to be invalid.

On the other hand, when the set value is judged not lower than the lower limit value (for example, "30°") (step S35: No), the microcomputer 31 proceeds to step S37 and memorizes the corrected value 61 in the $E^2$PROM 55. In more detail, assuming that the initial value of the amendment value 61 is "0" and the constant value T is "+1", the amended value of the amendment value 61 becomes "−1" and this value "−1" is memorized as the amendment value 61 in the $E^2$PROM 55. Thereafter, at step S38, the procedures of the flow chart in FIG. 4 terminates by indicating the set value by calculation of the combination of the turning ON of the nine display LEDs 51.

In this embodiment, the indication is made by the combination of the turning ON of the nine display LEDs, but such indication can be omitted and terminates without indication of the set value.

On the other hand, when the microcomputer 31 judges the pushed down switch does not correspond to the lower temperature switch (Step S33: No), at step S39, at step S34 the amendment value 61 is substituted for the value subtracted by the constant value T and proceeds to step S40 At the step S40, the microcomputer 31 judges whether the set value subtracting the amended value of the amendment value 61 from the target value 59 (corresponding to the "Intermediate" temperature of the display LED 51: 40° C.) is higher than a higher temperature limit value (for example "42° C.").

If the microcomputer 31 judges "Yes" (the set value is higher than the higher temperature limit value "43° C.": S40: Yes), then proceeds to step S41 to turn on/off, one of the nine display LEDs 51 and terminates procedures in the flow chart shown in FIG. 4.

Accordingly, according to the sanitary device 1 of the embodiment, the temperatures of the cleansing water in the heating water tank 17 can be prevented from shifting to each higher side from "High" (from 40° C.), "Intermediate" (from 43° C.), and "Low" (from 46° C.), and at the same time the operation of the high temperature switch (for example, toilet seat switch 22 corresponding to the high temperature switch) at the step S33 can be determined to be invalid.

On the other hand, when the microcomputer 31 judges that the set value is not lower than the high temperature limit value (for example "43° C.") (step S40: No), the microcomputer proceeds to the step S42 to memorize the amendment value 61 in the $E^2$PROM 55.

In more detail, assuming that the initial value of the amendment value 61 is "0" and the constant value T is "+1", the amended value of the amendment value 61 becomes "−1" at step S39 and this value "−1" is memorized as the amendment value 61 in the $E^2$PROM 55. Thereafter, at step S43, the procedure of the flow chart in FIG. 4 terminates by indicating the set value by calculation of the combination of the turning ON of the nine display LEDs.

In this embodiment, the indication is made by the combination of the turning ON of the nine display LEDs at step S43, but such indication can be omitted and terminates without indication of the set value.

As described, in the sanitary device 1 according to the embodiment, the microcomputer 31 controls the temperature of the cleansing water in the heating water tank 17 in three steps "High", "Intermediate" and "Low" wherein the "Intermediate" temperature is controlled to 40° C. and corresponding to the target value 59, the "High" temperature is controlled to the target value 59 plus 3° C. and the "Low" temperature is controlled to the target value 59 minus 3° C. At the same time by corrected correction value 60 memorized in the $E^2$PROM 55, the variations of the circuit constant of the control substrate 19 which is the cause of the control difference of the temperature control can be absorbed.

(FIGS. 1 and 2).

As shown in FIG. 2, the microcomputer 31 can automatically change the memorized correction value 60 in the $E^2$PROM 55 based on the variation of the circuit constant of the control substrate 19 (steps S14, S16, S17 and S18) and accordingly the adjusting operation for the absorbing the dispersion of the circuit constant of the control substrate 19 can be facilitated.

Figure 8:
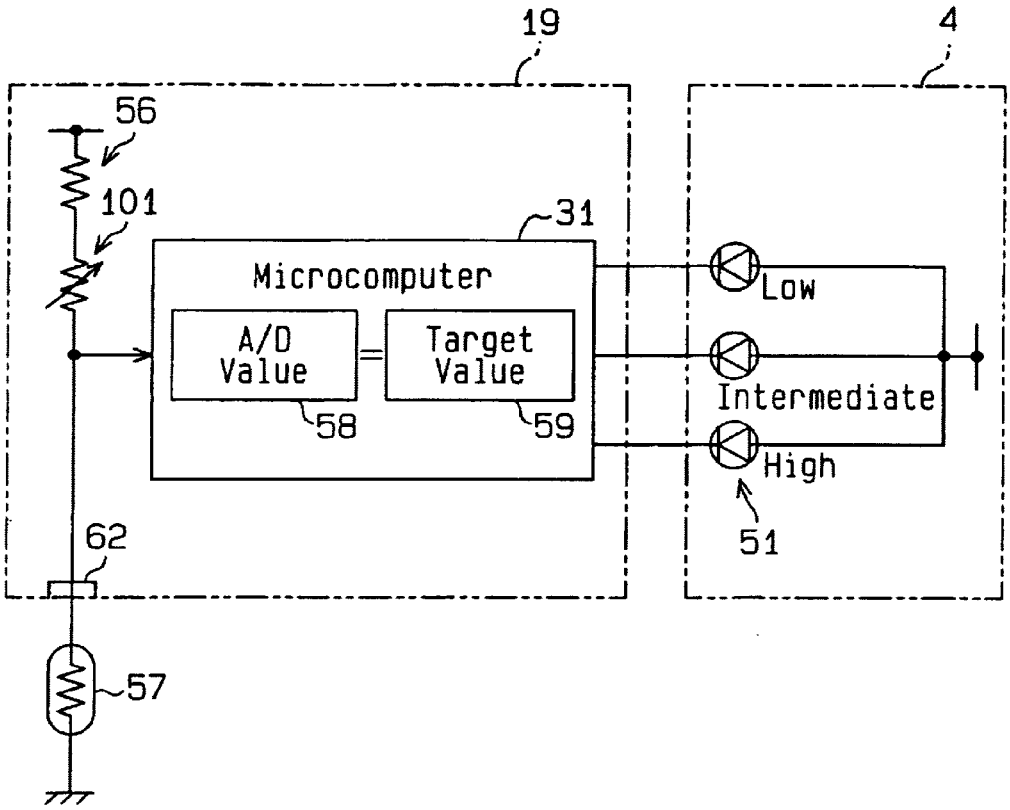
Fig.8 PRIOR ART
FIG. 8 is a part of the block diagram of the sanitary device according to the conventional art.

In the sanitary device 1 according to the embodiment, the variable resistor 101 which is used in the conventional art shown in FIG. 8 is not used, and the adjusting operation for absorbing the variation of the circuit constant of the control substrate, which is the cause of the control difference of the temperature control can be achieved without limitation of the variable range of the resistor 101.

As described, in the sanitary device 1 according to the embodiment, the microcomputer 31 controls the temperature of the cleansing water in the heating water tank 17 in three steps "High", "Intermediate" and "Low" wherein the "intermediate" temperature is controlled to 40° C. corresponding to the target value 59, the "High" temperature is controlled to the target value 59 plus 3° C. and the "Low" temperature is controlled to the target value 59 minus 3° C. At the same time, by corrected amendment value 61 memorized in the $E^2$PROM 55, the three step temperatures for the cleansing water in the heating water tank 17 can be shifted to a higher side or a lower side while keeping the temperature difference (here, 3° C.) between the steps to control the temperature based on the individual preference or the area weather conditions where the device is to be sold. (FIGS. 1, 3 and 4).

The microcomputer 31 changes the memorized amendment value 61 in the $E^2$PROM 55 based on the inputs from the operation panel 4, heating water switch 21, toilet seat switch 22 and stop switch 26 as shown in FIGS. 3 and 4 (steps S25, S27 and S29 in FIG. 3 and steps S34, S37, S39 and S42). Accordingly, there is no need to open the cover of the housing 20, and the adjusting operation for setting the temperature to be suitable for the individual preference or the weather condition in the area to be sold can be facilitated.

According to the sanitary device 1 according to the embodiment in FIG. 4, the set value is compared with the lower limit temperature value at step S35 and compared with the higher limit temperature value at step S40 to define the changeable range of the amendment value 61 memorized in the $E^2$PROM.

Accordingly, the changing of the amendment value 61 based on the inputs from the operation panel 4, heating water switch 21, toilet seat switch 22 and stop switch 26 can be made within the changeable range (step S35: No, step S40: No). Upon the adjusting work for setting the temperature to be suitable for the individual preference or the weather conditions in the area to be sold, the temperature of the cleansing water in the heating water tank 17 can be safely controlled since shifting to the higher side from the set temperatures of 40, 43 and 46° C. is prevented.

According to the sanitary device 1 according to the embodiment, as shown in FIGS. 3 and 4, the set value "Intermediate" among the control temperatures "High", "Intermediate" and "Low" is indicated by the combination of the nine turning On's of the display LEDs 51 (step S23 in FIG. 3, steps S38 and S43 in FIG. 4). Accordingly, upon the adjusting operation for setting the temperature to be suitable for the individual preference or the weather condition in the area to be sold, while inputting the heating water switch 21, toilet seat switch 22 and stop switch 26, the combination of the turning On of the nine display LEDs of the operation panel 4 can be confirmed to provide a standard for the adjusting operation.

The invention has been explained according to the preferred embodiment, but it is possible to make changes within the scope of the invention.

For example, the temperature of the drying air from the outlet 18 of the drying air unit can be controlled to the target value 59 by the microcomputer 31 in the control substrate 19 or the toilet seat temperature of the toilet seat 3 can be controlled to the target value 59. In these cases, the target value 59, correction value 60 and the corrected amendment value 61 memorized in the $E^2$PROM 55 are individually preset.

According to the invention, in the sanitary device, the microcomputer installed on the control substrate controls the temperature of the cleansing water in the heating water tank to the target value and absorbs the variations of the circuit constant causing the control difference of the temperature control, by using the correction value memorized in the nonvolatile memory.

In the sanitary device according to the invention, by providing the indicating means for indicating the target value reflecting the correction value, during the adjusting operation for adjusting the temperature based on the individual preference or the weather conditions or characteristics of the area where the device is to be sold, the target value reflecting the correction value can be confirmed while the operation switch is operated to provide a standard value for the adjusting operation.

In the sanitary device according to the invention, by providing the predetermined range for correcting the correction value, even when the operation switch is operated to adjust the temperature based on the individual preference or the weather condition, the microcomputer can correct the correction value only within the determined range and the adjusting to a harmful temperature, especially to a high temperature setting, can be prevented.

In the sanitary device according to the invention, by providing the indicating means for indicating the target value reflecting the correction value, during the adjusting work for adjusting the temperature based on the individual preference or the weather condition or characteristics of the area where the device is to be sold, the target value reflecting the correction value can be confirmed while the operation switch is operated to provide a standard value for the adjusting operation.

It is further noted that the temperature of the drying air from the outlet of the drying air unit can be controlled to the target value or the toilet seat temperature can be controlled to the target value, which are installed on the control substrate.

What we claimed is:

1. A sanitary device comprising:

a microcomputer comprising means for controlling at least one of a temperature of cleansing water in a heating water tank, a temperature of drying air supplied from a drying air unit and a temperature of toilet seat, to a target value;

a control substrate installed on the microcomputer; and a non-volatile memory memorizing a correction value for the target value, wherein the microcomputer comprises means for correcting the correction value based on a variation of a circuit constant of the control substrate.

2. A sanitary device comprising:

a microcomputer comprising means for controlling at least one of a temperature of cleansing water in heating water tank, a temperature of drying air supplied from a drying air unit and a temperature of toilet seat, to a target value;

a control substrate installed on the microcomputer;

an operation switch connected to the control substrate; and a non-volatile memory memorizing a correction value for the target value, wherein the microcomputer comprises means for correcting the correction value based on an operation of the operation switch.

3. A sanitary device according to claim 2, wherein the microcomputer includes means for providing a predetermined range for correcting the correction value.

4. A sanitary device according to claim 2, wherein the microcomputer includes means for providing an indicating means for indicating the target value reflecting the correction value.

* * * * *